US009347741B2

(12) United States Patent
Wegner et al.

(10) Patent No.: US 9,347,741 B2
(45) Date of Patent: May 24, 2016

(54) HOLSTER MECHANISM

(71) Applicant: Blade-Tech Industries, Inc., Puyallup, WA (US)

(72) Inventors: Bryce Wegner, Puyallup, WA (US); Thomas Crawford, Gig Harbor, WA (US); Aaron Kravik, Puyallup, WA (US)

(73) Assignee: Blade-Tech Industries, Inc., Puyallup, WA (US)

( * ) Notice: Subject to any disclaimer, the term of this patent is extended or adjusted under 35 U.S.C. 154(b) by 38 days.

(21) Appl. No.: 13/921,076

(22) Filed: Jun. 18, 2013

(65) Prior Publication Data

US 2014/0217136 A1 Aug. 7, 2014

Related U.S. Application Data

(60) Provisional application No. 61/761,608, filed on Feb. 6, 2013.

(51) Int. Cl.
*F41C 33/02* (2006.01)

(52) U.S. Cl.
CPC ..... *F41C 33/0227* (2013.01)

(58) Field of Classification Search
CPC ..... F41C 33/0218; F41C 33/0227; F41C 33/0263
USPC ..... 224/242–246, 192–193, 198, 238
See application file for complete search history.

(56) References Cited

U.S. PATENT DOCUMENTS

| | | | | |
|---|---|---|---|---|
| 4,325,505 | A * | 4/1982 | Hillman | 224/238 |
| 8,104,656 | B1 * | 1/2012 | George | 224/674 |
| 8,602,275 | B1 * | 12/2013 | Kiger et al. | 224/243 |
| 8,807,404 | B1 * | 8/2014 | Howell et al. | 224/243 |
| 2005/0035163 | A1 * | 2/2005 | French et al. | 224/243 |
| 2006/0011680 | A1 * | 1/2006 | Cook et al. | 224/243 |
| 2007/0181619 | A1 * | 8/2007 | Seyfert et al. | 224/196 |
| 2009/0321480 | A1 * | 12/2009 | Kincaid et al. | 224/243 |
| 2011/0101063 | A1 * | 5/2011 | Zusman | 224/682 |
| 2013/0181020 | A1 * | 7/2013 | Rogers et al. | 224/243 |
| 2014/0027479 | A1 * | 1/2014 | Hogue | 224/183 |

* cited by examiner

*Primary Examiner* — Justin Larson
*Assistant Examiner* — Phillip Schmidt
(74) *Attorney, Agent, or Firm* — Wolfe-SBMC

(57) ABSTRACT

Holster mechanism techniques are described. In one or more implementations, an apparatus comprises a holster configured to secure a device, a hood connected to the holster, and a locking mechanism. The hood comprises a biasing portion configured to receive a force to cause the hood to move between a closed position and an open position. The locking mechanism comprises a first locking portion and a second locking portion configured to engage the first locking portion to secure the hood in the closed position or the open position.

20 Claims, 5 Drawing Sheets

HOLSTER MECHANISM

CROSS REFERENCE TO RELATED APPLICATIONS

This application claims priority under 35 U.S.C. 119(e) to U.S. Provisional Patent Application No. 61/761,608 which was filed on Feb. 6, 2013, and titled "Holster Mechanism," the disclosure of which is hereby incorporated by reference in its entirety.

BACKGROUND

Users may utilize a variety of different holsters to carry a variety of different devices. For example, users may use a holster to carry a pistol. In order to prevent inadvertent removal of the pistol from the holster, holster designs have been improved upon by attaching a strap, latch, or fastener that secures to the pistol. However, traditional techniques use fasteners that can be difficult for some users to unfasten quickly and efficiently, which in certain situations can affect a user's ability to remove the device from the holster in a timely manner in order to defend themself or another person. Therefore, the traditional techniques of securing devices within a holster may be frustrating and inefficient when the user desires to quickly remove the device from the holster.

SUMMARY

Holster mechanism techniques are described. In one or more implementations, an apparatus comprises a holster configured to secure a device, a hood connected to the holster, and a locking mechanism. The hood comprises a biasing portion configured to receive a force to cause the hood to move between a closed position and an open position. The locking mechanism comprises a first locking portion, and a second locking portion configured to engage the first locking portion to secure the hood in the closed position or the open position.

In one or more implementations, a method includes applying a force to a biasing portion of a hood that is connected to a holster, and responsive to applying the force to the biasing portion, moving the hood from a closed position to an open position to release a locking mechanism that is configured to secure the hood in the closed position, the closed position configured to secure a device within the holster.

In one or more implementations, an apparatus comprises a hood configured to be connected to a holster for securing a device within the holster, a first locking portion configured to engage a second locking portion to form a locking mechanism, the locking mechanism being configured to secure the hood in a closed position for securing the device within the holster without the hood being connected to the device, and a biasing portion configured to receive a physical force applied by a user to cause the hood to be moved between the closed position and an open position, the closed position configured to secure the device within the holster, the open position configured to enable removal of the device from the holster.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

BRIEF DESCRIPTION OF THE DRAWINGS

The detailed description is described with reference to the accompanying figures. In the figures, the left-most digit(s) of a reference number identifies the figure in which the reference number first appears. The use of the same reference numbers in different instances in the description and the figures may indicate similar or identical items.

DETAILED DESCRIPTION

Overview

A variety of different holsters may be employed by a user to carry an item. However, traditional techniques used to secure the item within the holster to prevent inadvertent removal of the item were inefficient and sometimes difficult for a user to unfasten quickly, thereby resulting in frustration and potentially affecting the user's ability to remove the item in a timely manner in order to defend themself or another person.

Techniques to secure an item within a holster are described. In an implementation, a plastic form-fitted shell is designed to retain devices on a user's person. A hood may be attached to the shell to employ a locking mechanism to provide a positive lock to "snap" the hood into a closed position. While in the closed position, the hood is positioned to cover a portion of the device that is retained within the shell, thereby preventing removal of the device from the shell. To release the item, a locking mechanism may be released by moving the hood from the closed position into an open position responsive to a force applied by a user to a biasing portion. Further discussion of a holster mechanism employing a locking mechanism with a hood may be found in relation to FIGS. 1-10.

Additionally, the holster may be ambidextrous in that a portion used to attach the holster to a fixture (e.g., a belt clip to attach to a belt or other structure) may be mounted on either side of the holster. Additionally, the portion used to attach the holster may be configured in a variety of ways, such as a lockable/unlockable plate that is configured to engage a belt or strap for mounting in a variety of locations, such as a belt, thigh rig, shoulder rig, and so on, example of which are described in relation to FIG. 1. In embodiments, the portion may include one or more loops through which the belt or strap may be threaded.

Although the following illustrates an example of a device configured as a pistol that is received in the holster, a wide variety of other devices are contemplated. For example, devices may be configured as a firearm, a taser, a pepper spray device, an electric hand tool such as a drill, circular saw, cordless screwdriver, reciprocating saw, flashlight, a pneumatic tool (e.g., impact wrench), a non-powered tool (e.g., a hammer, screwdriver, hand saw, knife), and so on.

Figure 1:
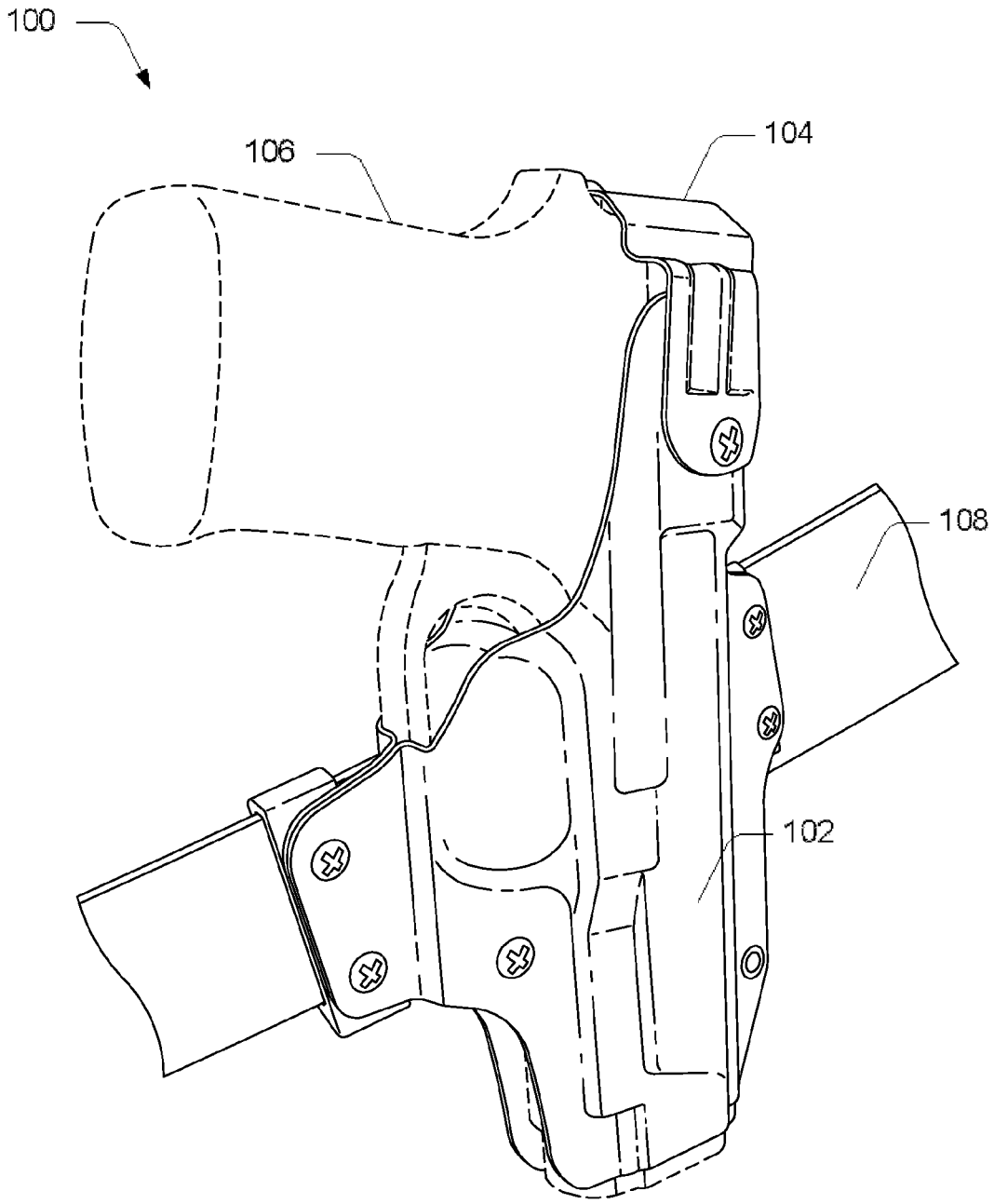
FIG. 1 is an illustration of an example implementation of a holster mechanism securing a device within the holster.

FIG. 1 illustrates an example implementation 100 of a of a holster mechanism that includes a holster 102 and a hood 104 securing a device 106 within the holster 102, and securing the holster 102 to an item 108 wearable by a user. The device 106 in this case is configured as a pistol, although other devices are also contemplated. For example, devices that may be retained by the holster 102 mechanism include firearms, tasers, pepper spray devices, and even manual-power tools such as hammers, wrenches, knives, and so on. Power tools may also be retained by the holster mechanism, such as electric (e.g., corded or cordless), pneumatic, combustion powered, and so on.

The holster mechanism secures the device 106 within the holster 102 by securing the hood 104 in a closed position. In the closed position, the hood 104 is configured to cover at least a portion of the device 106 to prevent removal of the device 106 from the holster 102. For example, the hood 104 is configured to cover a portion of a first end of the device 106 that is opposite a second end of the device 106 that is inserted into the holster 102. In this way, inadvertent removal of the device 106 is prevented and the device 106 is secured within the holster 102 without the hood 104 connecting to the device 106. When secured by the holster mechanism, the device 106 may be carried "hands free" by the user, and thus permit use of the user's hands for other tasks.

Figure 2:
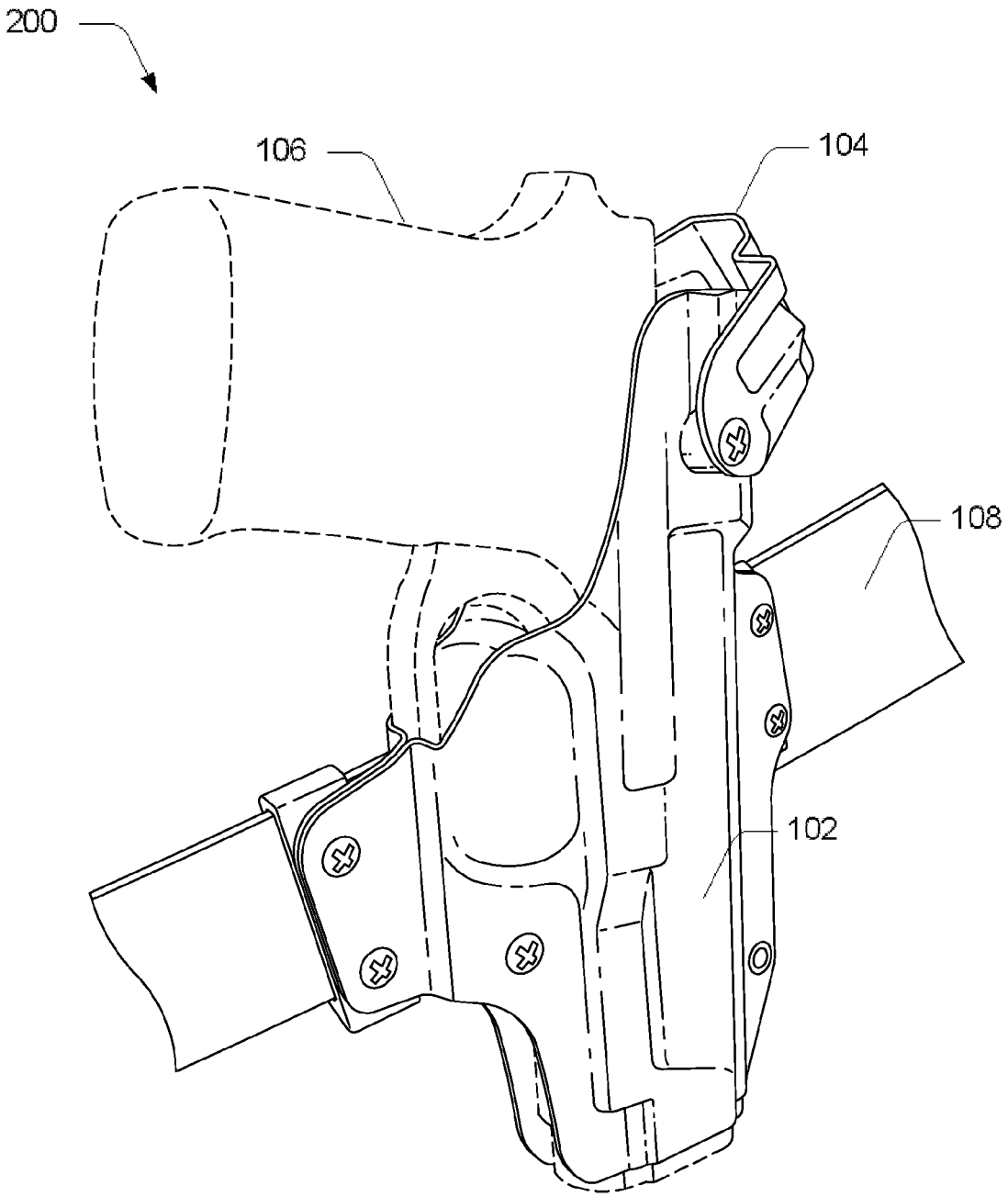
FIG. 2 is an illustration of an example implementation of a holster mechanism enabling removal of a device from the holster.

FIG. 2 is an illustration of an example implementation of a holster mechanism enabling removal of the device 106 from the holster 102. For example, the hood 104 is positioned in an open position, thereby allowing the device 106 to be removed or inserted into the holster 102. The holster 102 is configured in this example implementation as a shell formed from a flexible plastic.

The shell of the holster 102 may be constructed by joining two or more sections to form a generally sleeve like structure. In implementations, the sleeve is configured to be form-fitting to the device 106 of FIG. 1 that is to be retained by the holster 102, such as to follow contours of the device 106 that is to be secured therein. For example, the shell may be configured to follow contours of a particular make and model of a taser.

Figure 3:
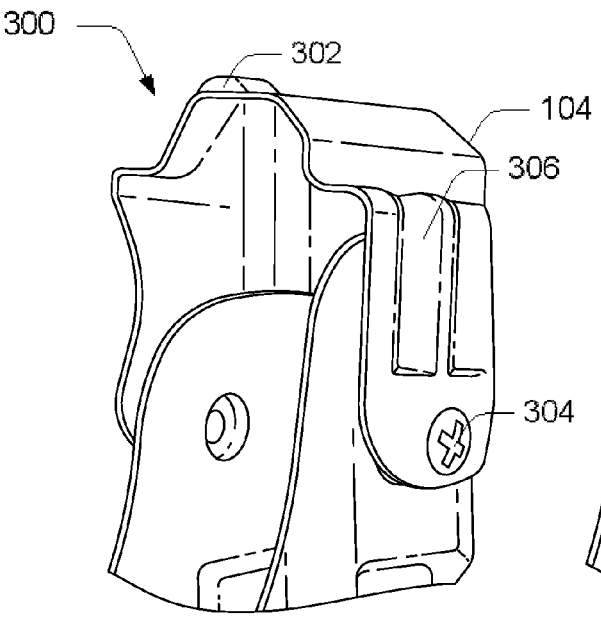
FIG. 3 is an illustration showing a perspective of the hood of the holster mechanism in a closed position.
Figure 4:
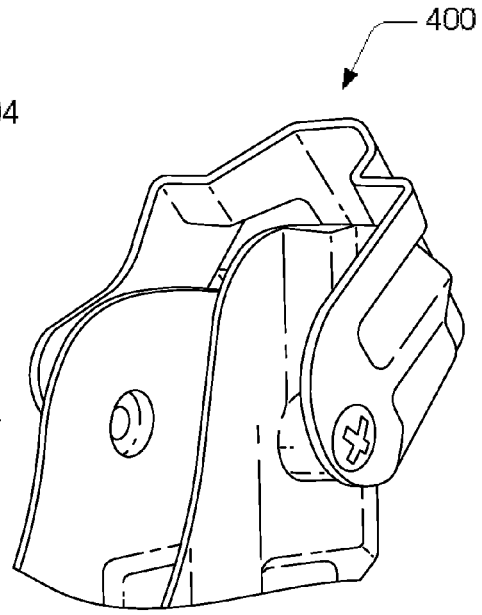
FIG. 4 is an illustration of an example implementation the hood of the holster mechanism in an open position.
Figure 5:
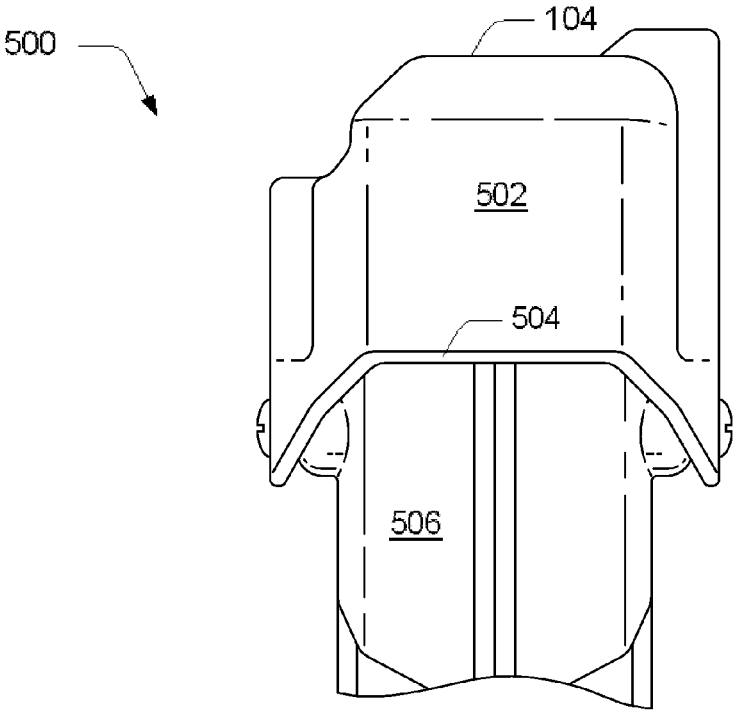
FIG. 5 is an illustration showing a perspective of the hood in the closed position.

Further discussion of the hood 104 may be found in relation to FIGS. 3-5. FIG. 3 is an illustration showing a perspective of an example implementation 300 of the hood 104 of the holster mechanism of FIG. 1 in the closed position. The hood 104 may include a biasing portion 302, a pivot point 304, and at least a first portion 306 of a locking mechanism.

The biasing portion 302 may be used by a user by applying a force (e.g., pushing with the user's thumb, finger, palm, or other part of the user's hand) to the biasing portion 302 to cause the hood 104 to move from the closed position to the open position. For example, applying a force that is substantially perpendicular to a longitudinal axis of the holster 102 to the biasing portion 302 may cause the locking mechanism to release, and the hood 104 to rotate about the pivot point 304 from the closed position, as shown in FIG. 3, to the open position, as shown in FIG. 4.

Alternative embodiments for moving the hood 104 between positions are also contemplated. For example, slidable movement may be used to slide the hood 104 between positions using a track, rail, pin, wheel, and so on, rather than a pivot point. In an embodiment, a force applied to the biasing portion 302 may release the locking mechanism by causing the hood 104 to slidably move from the closed position to the open position.

The biasing portion 302 may be disposed on the hood 104 on a side that is proximate to the user when the holster 102 is attached to an item wearable by the user. Locating the biasing portion 302 relatively close to the user's body, may provide a more comfortable and natural position for the user's hand when attempting to release the locking mechanism and remove the device 106. For example, the user may pistol grip the device 106 with the extending laterally towards the biasing portion 302. While gripping the device 106, the user's may comfortably reach the side of the hood 104 that is closest to the user's body, and thereby apply a force to the biasing portion 302 of the hood 104. However, it should be readily apparent to a person of ordinary skill in the art that this design may be reversed (e.g., the biasing portion 302 may be arranged on another side of, or location on, the hood 104).

The first portion 306 of the locking mechanism may be disposed on a side of the hood 104 is opposite the biasing portion 302, on a same side as the biasing portion 302, or on another side of the hood 104. The locking mechanism is configured to secure the hood 104 in the closed position, as shown in FIG. 3, such that the hood 104 covers a portion of a device 106 held within the holster 102 to prevent inadvertent removal of the device 106 from the holster 102. The locking mechanism is also configured to secure the hood 104 in the open position, as shown in FIG. 4, such that the hood 104 does not cover the portion of the device 106. In this way, the hood 104 in the open position allows for insertion and/or removal of the device 106 from the holster 102.

FIG. 5 illustrates another perspective of the hood 104 in the closed position. Here, the hood 104 is shown having at least a face 502 and a lower edge 504. In the closed position, the face 502 of the hood 104 may contact a side 506 of the holster 102 to provide a stop point when moving the hood 104 from the open position to the closed position. In this way, the face 502 of the hood 104 may aid the locking mechanism in securing the hood 104 in the closed position. The lower edge 504 of the hood 104 may be disposed such that when the hood 104 is in the open position, the lower edge 504 of the hood 104 contacts the holster's side 506 to provide a stop point in the movement of the hood 104 towards the open position. In this way, the lower edge 504 of the hood 104 may aid the locking mechanism in securing the hood 104 in the open position. Further discussion of the locking mechanism is found below in relation to FIG. 10.

Figure 6:
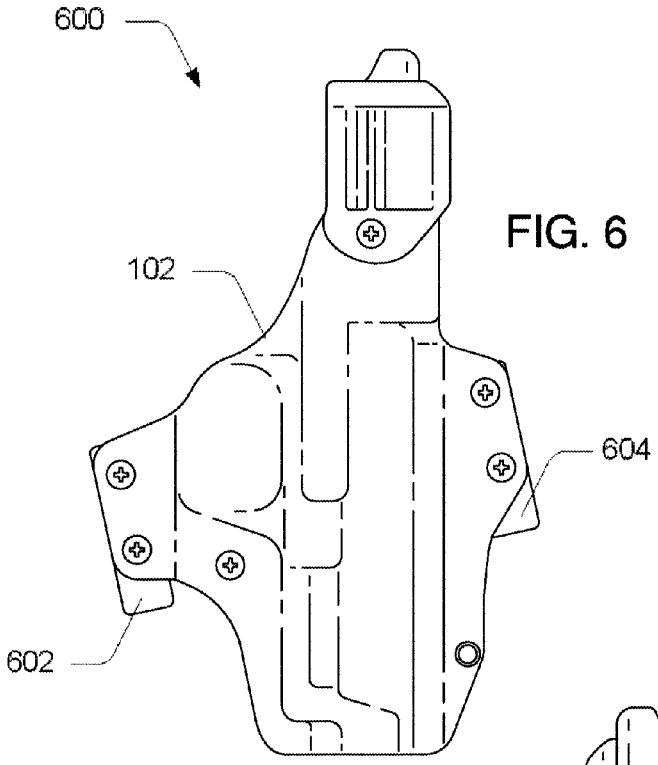
FIG. 6 is an illustration showing an additional perspective of the holster mechanism in the closed position.

FIG. 6 is an illustration showing a perspective of the holster mechanism in the closed position. In this view, the holster 102 is shown without a device 106 secured within the holster 102. The holster 102 may be formed to match contours of the device 106 such that the device 106 may fit snugly into the sleeve-like structure of the holster 102. In addition, the holster 102 may be attached to one or more members 602, 604 that are configured to engage a belt or strap for mounting in a variety of locations, such as a belt, thigh rig, shoulder rig, and so on. The members 602, 604 may be configured in a variety of ways, such as a loop through which a belt or strap may be threaded, or a lockable/unlockable plate configured to engage the belt or strap.

Figure 7:
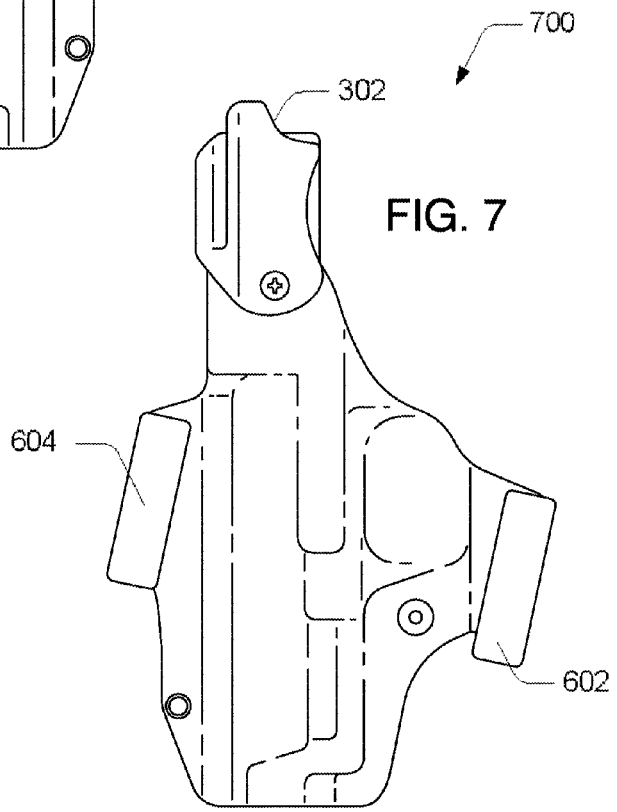
FIG. 7 is an illustration showing an additional perspective of the holster mechanism in the closed position.

FIG. 7 is an illustration showing an additional perspective of the holster mechanism in the closed position. In embodiments, the one or more members 602, 604 may be separate. Alternatively, the one or more members 602, 604 may be connected to one another. In addition, the biasing portion 302 on the hood 104, may be located on the same side of the holster mechanism as the one or more members 602, 604. Alternatively, the biasing portion 302 may be located on another side of the hood 104 that is different than the side of the holster 102 upon which the one or more members 602, 604 are located.

Figure 8:
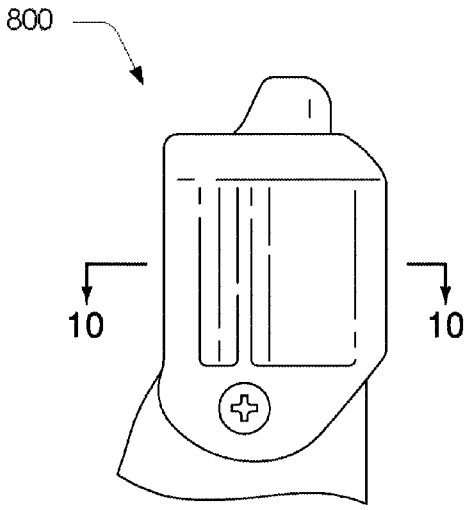
FIG. 8 is an illustration showing an additional perspective of the hood in the closed position.
Figure 9:
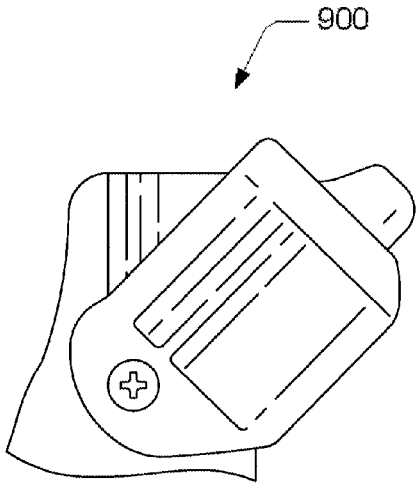
FIG. 9 is an illustration showing a perspective of the hood in the opened position.
Figure 10:
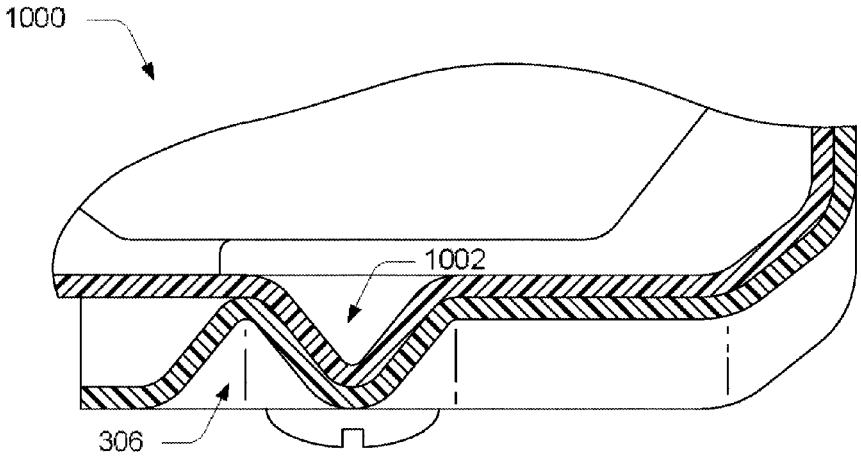
FIG. 10 depicts a cross-section view of the holster mechanism in FIG. 8 in the closed position.

Further discussion of the locking mechanism may be found in relation to FIGS. 8-10. FIG. 8 is an illustration showing a perspective of the hood 104 in the closed position. FIG. 9 is an illustration showing a perspective of the hood 104 in the open position. FIG. 10 is a cross-sectional view 1000 of the hood 104 in FIG. 8 in the closed position.

In an embodiment, the locking mechanism may include one or more locking portions, such as a first locking portion 306 and a second locking portion 1002. In embodiments, the first locking portion 306 may be located on the hood 104 and the second locking portion 1002 may be located on the holster 102. However, it should be readily apparent to a person of ordinary skill in the art that this design may be reversed (e.g., the first locking portion 306 may be located on the holster 102 and the second locking portion 1002 may be located on the hood 104). In embodiments, the first locking portion 306 and/or the second locking portion 1002 may be configured as a protrusion or an indentation. In an implementation, both the first locking portion 306 and the second locking portion 1002 may include protrusions.

In an embodiment, the hood 104 may engage the holster 102 using a protrusion or indentation that is fitted to engage the protrusion or indentation on the holster 102, thereby providing a positive lock to "snap" the hood 104 into the closed position. For instance, the hood 104 may be configured to flex as the hood 104 is moved from the open position to the closed position so that the protrusion or indentation on the hood 104 may engage the protrusion or indentation on the holster 102. In embodiments, the locking mechanism is configured such that the hood 104 is not biased when in the closed position and/or when in the open position.

In this way, the locking mechanism is configured to secure the hood 104 to the holster 102 in the closed position and/or in the open position, rather than secure the hood 104 to the device 106 in the holster 102. The hood 104 may therefore secure the device 106 in the holster 102 without attaching or connecting to the device 106.

Conclusion

Although the invention has been described in language specific to structural features and/or methodological acts, it is to be understood that the invention defined in the appended claims is not necessarily limited to the specific features or acts described. Rather, the specific features and acts are disclosed as example forms of implementing the claimed invention.

What is claimed is:

1. An apparatus comprising:

a holster configured to secure an item;

a hood connected to the holster, the hood comprising a biasing portion configured to receive a force to cause the hood to move between a closed position and an open position; and a locking mechanism comprising:

a first locking portion disposed on the hood and including a first protrusion or indentation; and a second locking portion disposed on the holster and including a second protrusion or indentation that is configured to engage the first protrusion or indentation on the first locking portion to secure the hood in the closed position, the second locking portion further configured to engage the first locking portion to secure the hood in the open position; and the hood configured to flex when transitioning between the closed position and the open position based on the second locking portion engaging the first locking portion, the hood being not biased in the closed position and not biased in the open position.

2. An apparatus as described in claim 1, wherein the hood is rotatably movable about a pivot point between the closed position and the open position.

3. An apparatus as described in claim 1, wherein the item is a firearm.

4. An apparatus as described in claim 1, wherein the item is an electroshock weapon or pepper spray device.

5. An apparatus as described in claim 1, wherein the item is a knife.

6. An apparatus as described in claim 1, wherein one or more of the first locking portion or the second locking portion is a raised surface.

7. An apparatus as described in claim 1, wherein the hood is not connectable to the item.

8. An apparatus as described in claim 1, wherein the hood is slidably movable between the closed position and the open position.

9. A method comprising:

applying a force to a biasing portion of a hood that is connected to a holster; and responsive to applying the force to the biasing portion, causing a locking mechanism to release by moving the hood from a closed position to an open position, the hood configured to flex when moving from the closed position to the open position based on a first protrusion or indention that is disposed on the hood engaging a second protrusion or indentation that is disposed on the holster, the hood being not biased in the closed position and not biased in the open position, the locking mechanism being configured to secure the hood in the closed position, the closed position configured to secure a device within the holster by covering at least part of a first end of the device that is opposite a second end of the device that is inserted into the holster.

10. A method as recited in claim 9, wherein moving the hood from the closed position to the open position comprises causing rotatable movement of the hood about a pivot point.

11. A method as recited in claim 9, further comprising responsive to moving the hood from the closed position to the open position, enabling a user to remove the device from the holster or insert the device into the holster.

12. A method as recited in claim 11, wherein the holster is configured to removably attach to an item that is wearable by a user.

13. A method as recited in claim 9, wherein the locking mechanism includes a first locking portion and a second locking portion, and wherein the first locking portion includes the first protrusion and the second locking portion includes the second protrusion.

14. A method as recited in claim 9, wherein moving the hood from the closed position to the open position comprises causing slidable movement of the hood along a track or a rail.

15. An apparatus comprising:

a hood configured to be connected to a holster for securing a device within the holster;

a first locking portion configured to engage a second locking portion to form a locking mechanism, the first locking portion disposed on the hood and including a first protrusion or indentation, the second locking portion disposed on the holster and including a second protrusion or indentation, the locking mechanism being configured to:

secure the hood in a closed position for securing the device within the holster without the hood being connected to the device; and secure the hood in an open position to enable insertion or removal of the device from the holster; and a biasing portion configured to receive a physical force applied by a user to cause the hood to be moved between the closed position and an open position, the closed position configured to secure the device within the holster, the open position configured to enable removal of the device from the holster, the hood configured to flex when transitioning between the closed position and the open position based on the first locking portion engaging the second locking portion.

16. An apparatus as recited in claim 15, wherein the hood is further configured to be connected to the holster via a pivot point to enable rotatable movement between the closed position and the open position.

17. An apparatus as recited in claim 15, wherein the first locking portion is configured to engage the second locking portion to enable slidable movement of the hood between the closed position and the open position.

18. An apparatus as recited in claim 15, wherein the hood is further configured to cover at least a portion of the device to prevent removal of the device from the holster when the hood is in the closed position.

19. An apparatus as recited in claim 15, wherein the device is one of a firearm, a pistol, an electroshock weapon, a pepper spray device, or a knife.

20. An apparatus as recited in claim 15, wherein one or more of the first locking portion or the second locking portion comprises a raised surface.

* * * * *